US009302140B2

(12) United States Patent
Muhammad

(10) Patent No.: US 9,302,140 B2
(45) Date of Patent: Apr. 5, 2016

(54) SEATED MULTI-FUNCTION WHOLE BODY EXERCISE MACHINE

(71) Applicant: Kenyatta ibn Muhammad, Allentown, PA (US)

(72) Inventor: Kenyatta ibn Muhammad, Allentown, PA (US)

( * ) Notice: Subject to any disclaimer, the term of this patent is extended or adjusted under 35 U.S.C. 154(b) by 0 days.

(21) Appl. No.: 14/558,443

(22) Filed: Dec. 2, 2014

(65) Prior Publication Data

US 2015/0151154 A1 Jun. 4, 2015

Related U.S. Application Data

(60) Provisional application No. 61/911,363, filed on Dec. 3, 2013.

(51) Int. Cl.

| | |
|---|---|
| ***A63B 21/00*** | (2006.01) |
| ***A63B 21/06*** | (2006.01) |
| ***A63B 21/012*** | (2006.01) |
| ***A63B 21/062*** | (2006.01) |
| ***A63B 21/015*** | (2006.01) |
| ***A63B 23/12*** | (2006.01) |
| *A63B 71/00* | (2006.01) |

(52) U.S. Cl.

CPC ..... *A63B 21/062* (2013.01); *A63B 21/015* (2013.01); *A63B 21/063* (2015.10); *A63B 21/0628* (2015.10); *A63B 21/156* (2013.01); *A63B 23/1218* (2013.01); *A63B 23/1263* (2013.01); *A63B 23/1281* (2013.01); *A63B 2071/0018* (2013.01); *A63B 2225/09* (2013.01)

(58) Field of Classification Search

CPC ..... A63B 21/00058; A63B 21/00061; A63B 21/00069; A63B 21/00072; A63B 21/00076; A63B 21/012; A63B 21/0125; A63B 21/015; A63B 21/018; A63B 21/06; A63B 21/0609; A63B 21/062; A63B 21/0622; A63B 21/0624; A63B 21/0626; A63B 21/0628; A63B 21/063; A63B 21/0632; A63B 21/15; A63B 21/151; A63B 21/152; A63B 21/153; A63B 21/154; A63B 21/155; A63B 21/156; A63B 21/16; A63B 21/1609; A63B 21/22; A63B 21/40; A63B 21/4027; A63B 21/4029; A63B 21/4031; A63B 21/4033; A63B 21/4034; A63B 21/4035; A63B 21/4041; A63B 21/4043; A63B 21/4045; A63B 21/4047; A63B 21/4049; A63B 23/00; A63B 23/035; A63B 23/03508; A63B 23/03516; A63B 23/03525; A63B 23/03533; A63B 23/03541; A63B 23/0355; A63B 23/03558; A63B 23/03566; A63B 23/03575; A63B 23/03583; A63B 23/03591; A63B 23/04; A63B 23/0405; A63B 23/0476; A63B 23/0482; A63B 23/0494; A63B 23/10; A63B 23/1209; A63B 23/1218; A63B 23/1263; A63B 23/1281; A63B 2071/0018; A63B 2225/09; A63B 2225/10; A63B 2225/102; A63B 2225/105; A63B 2225/107

USPC ..... 482/51, 62, 63, 79, 80, 92–94, 98–103, 482/114–115, 118–119, 133, 135–139, 148, 482/904, 908

See application file for complete search history.

(56) References Cited

U.S. PATENT DOCUMENTS 2,795,422 A * 6/1957 Bartlett ..... A61G 5/02 280/211
3,712,613 A * 1/1973 Feather ..... A61H 1/02 482/138

(Continued)

*Primary Examiner* — Stephen Crow
*Assistant Examiner* — Joshua Lee
(74) *Attorney, Agent, or Firm* — Sanford J. Piltch

(57) ABSTRACT

A multi-function exercise machine for exercising the upper, middle and lower body from a seated position including pull down, leg press, and forward and rearward wheel exercise regimens, all with adjustable resistance and weight capabilities, for exercising specific targeted muscle groups.

8 Claims, 3 Drawing Sheets

(56) References Cited

U.S. PATENT DOCUMENTS 5,409,440 A * 4/1995 Yang ..... A63B 21/06
482/101

2009/0124461 A1* 5/2009 Pinto ..... A63B 21/002
482/7

2015/0065305 A1* 3/2015 Dalton ..... A63B 21/023
482/52

* cited by examiner

SEATED MULTI-FUNCTION WHOLE BODY EXERCISE MACHINE

BACKGROUND OF THE INVENTION

Physical fitness and health concerns are among the areas of highest concern among Americans today. More than ever, people are frequenting health clubs and performing exercise routines at home in order to lose weight, and maintain a healthy lifestyle. While there are many different types of exercise machines available, they typically only work on certain areas of the body such as chest and arms, or lower body and legs. This means that a person must move from machine to machine for a full body workout. Those exercising at home must also have space and the money to afford two or more different types of exercise machines as well. Accordingly, there exists a need for a means by which a user can obtain a full body workout from a single exercise machine.

The whole body exercise machine of the present invention provides a seating area in which a user sits that is positioned between two rotatable exercise wheels, resembling those of a wheelchair. The wheels are capable of both clockwise and counter-clockwise rotation and are user adjustable; to provide more or less friction, increasing or decreasing the force required to rotate the wheels. An arched overhead frame area provides a counter-weighted pull-down bar that is position adjustable from a position directly overhead to a position directly in front of the seated user. A user can perform leg press exercises while seated by using a push plate and lever mechanism that is also counter-weighted and adjustable for increasing or decreasing weight/resistance. Using the multi-function exercise machine of the present invention, unlike other limited body area exercise machines, provides users the benefit of a complete body workout in a manner that is quick, easy and effective, all without moving from machine to machine to accomplish a similar workout.

It is therefore an object of the present invention to provide workout exercises for all segments of a user's body, i.e., the upper, middle and lower portions of the body. It is also an object of the present invention to provide the types of exercises not usually combined in a single exercise machine to work the entire body. It is a further object of the present invention to afford the user the ability to work the upper, middle and lower portions of the body while remaining in a seated position.

Other objects will appear hereinafter.

SUMMARY OF THE INVENTION

A multi-function exercise apparatus for a seated user is described that includes a base with a front section and a rear section, an upright seat mounted to the rear section of the base that is adjustable forward and rearward in relation to the front section of the base, with the seat also being reclinable over a range from a fully upright position to a fully reclined position. The exercise apparatus also includes a pair of stationary exercise wheels located on either side of the seat being rotatable in both the forward and rearward directions by the seated user. The speed of the rotation of the wheels is user adjustable, to provide more or less friction, by increasing or decreasing the force required to rotate the wheels. A friction adjustment control is positioned adjacent each of the stationary wheels to increase or decrease friction between the control and the wheel, thus increasing or decreasing the force required to rotate the wheels.

The exercise apparatus also includes an arched overhead support for holding a pull-down bar operable by pulling toward the seated user from a retracted position. The pull-down bar is adjustably relocatable from directly overhead to directly in front of said user. Also, a leg press pad is positioned directly in front of the seated user and is operable by the user pushing forward against the pad. Both the pull-down bar and leg press pad are capable of exerting a counter-weighted force against the force of the user. The counter-weighted force is adjustable by increasing or decreasing the exerted weight/resistance force of a series of weight units by adding or removing weight units. Finally, an exercise function counter-weight selection and adjustment control is provided for selectively adding or removing weight units and selecting the pull-down bar or leg press pad for connection to the selected weight units for the exercise function selected by the user.

The weight units for the multi-function exercise apparatus are located in the front section of the base with each weight unit arranged atop one another in a stack and individually or collectively movable up and down along a paired set of guiderails. The pull-down bar of the multi-function exercise apparatus is mounted onto a relocatable trolley configured to move along the arched overhead support. The trolley and pull-down bar are capable of being adjustably relocated along the arched overhead support to predetermined positions and secured in said relocated positions by a pair of adjustment locking controls to secure the trolley in the relocated position. The trolley also provides a paired set of guides to permit a pair of cables that are located and extend or retract within the arched overhead support to be directed toward and attached to the pull-down bar without impeding their movement. As the trolley is lowered along the arched overhead support, the cables are retracted onto a cable take-up reel located in the front section of the base.

The exercise function counter-weight selection and adjustment control of the multi-function exercise apparatus is located between the pull-down bar and the leg press pad and the weight units such that the cables extending between the pull-down bar and the leg press pad are selectively engaged on the exercise function counter-weight selection and adjustment control. A set of cable clamps selectively engage and capture one or more cables to interconnect either the pull-down bar or the leg press pad through the exercise function counter-weight selection and adjustment control to the selected weight units. A set of extension rods are also mounted on the exercise function counter-weight selection and adjustment control. The extension rods are manually extendible to engage any one of the selected weight units to create an individual or combination set of weight units for use as the counter-weighted force against the force of the user. In this way the motion of the pull-down bar or leg press pad are translated to the selected weight units to provide the counter-weighted force against the force of the user.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
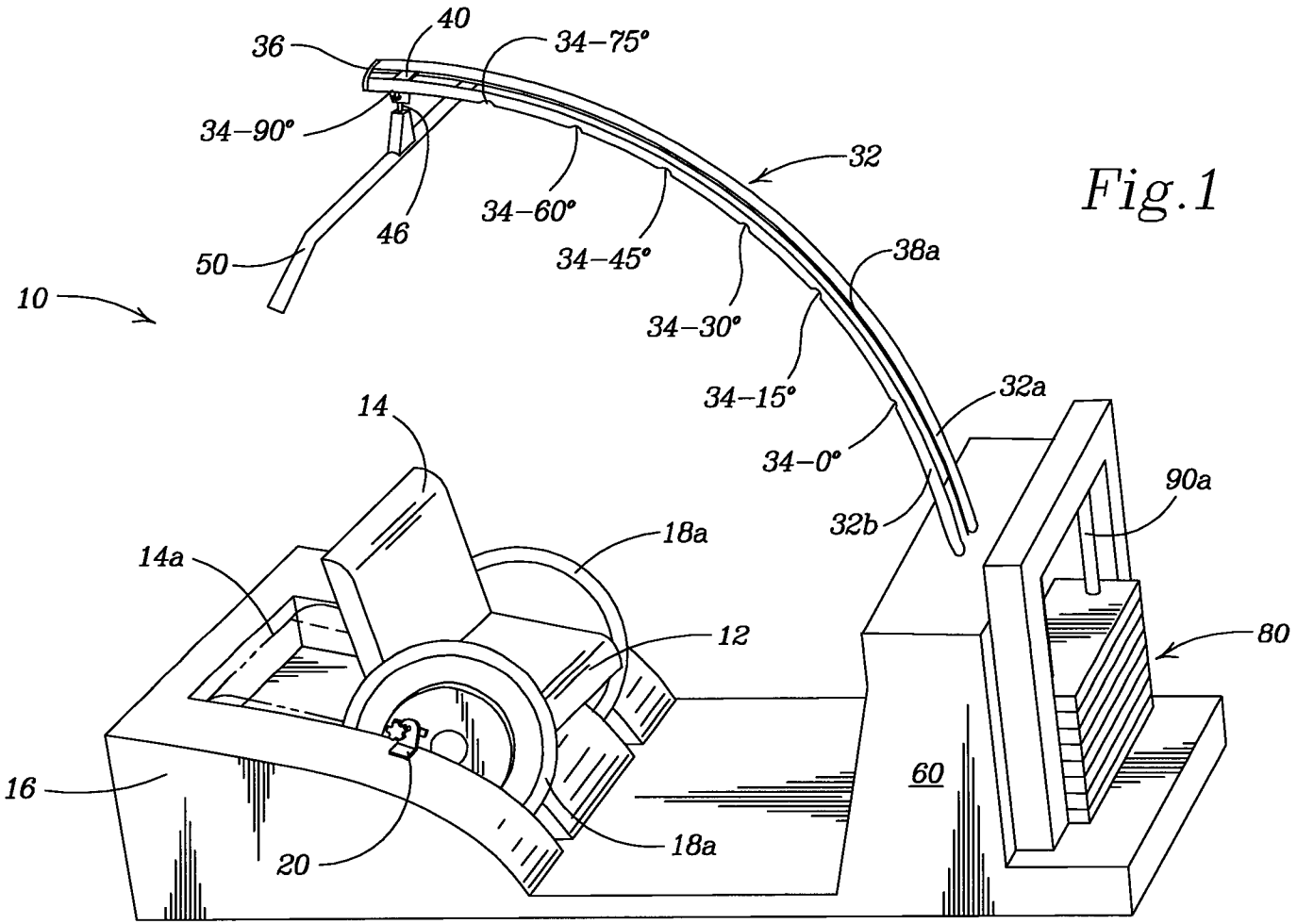
FIG. 1 is a perspective view of the present invention showing the adjustable seat, the arched overhead adjustable bar and the weight stack.

Referring now to the drawings in detail, where like numerals refer to like parts or elements, there is shown in FIG. 1 a multi-function exercise machine 10 of the present invention. An adjustable seat 12 accommodates users of differing heights. The seat 12 has an adjustable back 14 that can be adjusted between an upright position, as shown, to a fully reclined position 14*a*, shown in phantom lines. The seat 12 is situated in a frame 16 that accommodates the forward/rearward adjustment of the seat 12 on tracks (not shown) controlled by lever action similar to automobile seat adjusters as well known in the art. Situated on both sides of the seat 12 are wheels 18*a*, 18*b* that are similar to the wheels commonly used on wheelchairs. Also located on both sides of the seat 12 and associated with the wheels 18*a*, 18*b* are friction adjusters 20 that are adjustable to increase or decrease friction against the wheels 18*a*, 18*b* to increase or decrease the force required to rotate and continue rotating the wheels 18*a*, 18*b*.

Figure 3:
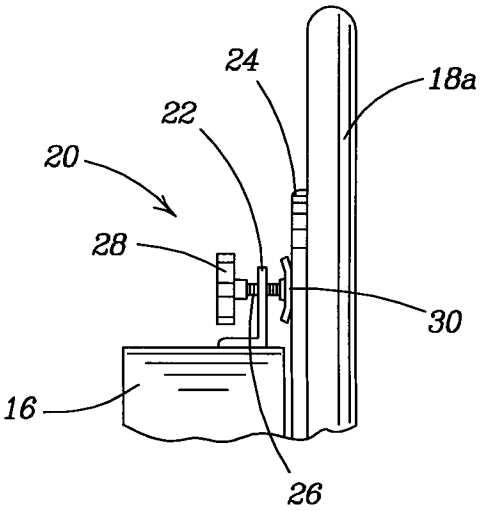
FIG. 3 is a side elevational view of the friction adjustment for the wheelchair-type exercise wheels of the present invention.

Referring now to FIG. 3, the adjustable friction control 20 includes an angle bracket 22 mounted along the top of frame 16 in close proximity to the wheelchair-type wheel 18*a* and a rotational speed control friction contact disk 24 affixed to the outward facing surface of wheel 18*a*. Bracket 22 is configured with a threaded aperture through which a threaded rod 26 extends having a knob or handle 28 at its outer end and a friction shoe 30 at its inner end contacting the friction disk 24 of the wheel 18*a*. By rotating the knob 28 in a clockwise direction the threaded rod 26 is moved in the direction of the disk 24 compressing the friction shoe 30 and increasing the force required to move the wheel 18*a* in either a forward or rearward direction. By rotating the knob 28 in a counterclockwise direction the threaded rod 26 is moved away from the disk 24 decreasing the force required to move the wheel 18*a*. The rotational motion of the threaded rod 26 within the threaded aperture of bracket 22 is intended to be a significantly high frictional contact to retard any rotational motion of the threaded rod 26 while a user exercises until the user desires to change the frictional contact of the shoe 30 against the disk 24 of the wheel 18*a*. Other mechanisms obtaining the same control and results as known in the art can be substituted for the described frictional control including the use of a lever system and direct frictional contact with the outer rim of either wheel 18*a*, 18*b*. An identical frictional control system is situated on the other side of the seat 12 along the far side of the frame 16 to contact the frictional disk 24 of wheel 18*b*.

The exercises that are contemplated by the use of wheels 18*a*, 18*b* are forward and rearward wheelchair motions, with a forward wheelchair exercise action the wheels 18*a*, 18*b*, either together or singly, are rotated in a forward rotational motion with the force required to continually rotate the wheels 18*a*, 18*b* regulated or controlled by the adjustable friction control 20. The targeted muscle groups for the forward wheelchair motion are the pectoralis major and serratus anterior (upper chest), deltoid and trapezius (shoulders), rectus abdominous (frontal core), and bicep and tricep brachii (upper arms). For the rearward wheelchair motion the targeted muscle groups engaged in the exercise are the same as for the forward wheelchair motion with the addition of the latissimus dorsi (mid-back). As strength and ability to continue the exercises in either directional motion increase in the user, additional friction can be applied to the wheels 18*a*, 18*b* by adjusting the friction control 20 to produce the additional force required for performing more strenuous exercise.

Referring again to FIG. 1, located above and to the front of seat 12 is an arched frame 32 extending upward from a base 60. The arched frame 32 is comprised of parallel tracks 32*a*, 32*b* extending upward in a curved array from a point directly in front of the seated user to a point directly above the seated user with the seat 12 in the forward position. Arrayed along the arcuate dimension of the arched frame 32, in each of the paired, parallel tracks 32*a*, 32*b* are a series of adjustment locations ranging from directly in front of the user at a point that is chest high when seated; 0°, to a point directly overhead of the user; 90°, with each adjustment location spaced apart an arcuate distance of 15°. The various adjustment locations 34 are also indicated with the arcuate distance X°. At each location the parallel tracks 32*a*, 32*b* include a detent along the underside of the track to accommodate a seat for an adjustment control 42 for the adjustable trolley 40 to be described more fully below. To maintain the tracks 32*a*, 32*b* in parallel alignment along their entire length, an end cap 36 spanning both tracks is located at the top end of the tracks 32*a*, 32*b*. To accommodate the adjustment of the trolley 40 between positions X°, opposing elongated openings 38*a*, 38*b* extend along the interior length of the tracks 32*a*, 32*b*.

Figure 2:
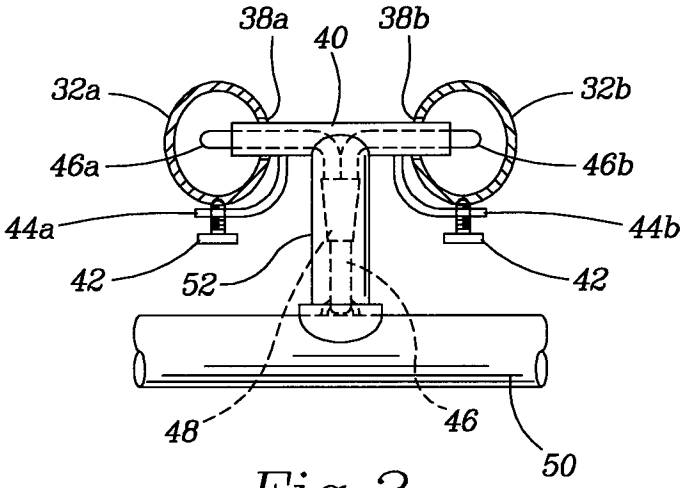
FIG. 2 is a sectional view of the arched overhead bar showing the cable/bar trolley and adjustment locks of the present invention.

Referring now to FIG. 2, the trolley 40 extends through the opposing elongated openings 38*a*, 38*b* in each of the tracks 32*a*, 32*b* to allow for a sliding motion up and down the tracks to relocate the trolley 40 at various X° positions. The trolley 40 also has distending arms 44*a*, 44*b* that extend around the inner lower sides of the tracks 32*a*, 32*b* to position the paired adjustment locking controls 42 at the distal ends of the arms 44*a*, 44*b* directly beneath each of the exercise positions X° of the exercise bar 50. The distal arms 44*a*, 44*b* can alternatively follow the shape of the outer surface of the tracks 32*a*, 32*b* regardless of that shape, but are required to span the distance between the main body of the trolley 40 and the various detents along the undersides of the tracks located at positions 34-X°.

Each of the adjustment locking controls 42 is threadably adjusted inward and outward so that an outward rotational motion will cause the threaded adjustment control to move out of the detent 34-X° to allow the trolley 40 to be slidably repositioned to a different X° location. Once at the new location, the threaded adjustment locking controls 42 can be rotated inward to lock the trolley 40 in its new position. Alternatively, the adjustment locking controls 42 may include a spring member that exerts an inward force toward the selected detent along the underside of the paired tracks 32*a*, 32*b* causing the tip of each control to enter and remain in each detent 34-X° until the spring force is manually overcome by the user to relocate the trolley 40 to a different location 34-X°.

The trolley 40 also includes cable guides for each of a paired set of cables 46*a*, 46*b* that are located and travel within each of the tracks 32*a*, 32*b* ending in a cable combiner and clamp 48 that combines the cables 46*a*, 46*b* into a single cable 46 that terminates at or within the exercise bar 50. The cable 46, i.e., each of the segments 46*a*, 46*b*, are free to move within the respective tracks 32*a*, 32*b* and through the trolley 40 such that the exercise bar 50 can move away from and toward the trolley 40, at whatever position 34-X°, the trolley 40 may be located to accommodate the exercise regimen of the user. The exercise bar 50, from an extended position away from the trolley 40, self-relocates to its retracted position by use of a collar 52 that surrounds the combined cable 46 and any portion of the separate cables 46*a*, 46*b* that may extend outward from the collar 52 during exercise regimens. The exercise bar 50 is connected by the cables 46*a*, 46*b* to a self-retracting cable wheel 62 located in base 60 to be described more fully below. The self-retracting cable wheel 62 allows the exercise bar 50 to be pulled away from the tracks 32*a*, 32*b*, by unwinding and extending the length of cable 46 between the exercise bar 50 and the tracks 32*a*, 32*b*.

The exercises that are contemplated by the use of the exercise bar 50 and the various adjustment location 34-X° are exercises for the back and core muscles of the body that will selectively change as the angle of the adjustment locations 34-X° change between 90° and 0°. The overall targeted muscle groups are the latissimus dorsi, teres major, rhomboids major and minor, and posterior deltoid (upper and middle back), bicep brachii and brachialis (shoulder), serratus anterior (upper body side), brachioradialis (forearm), interior trapezius (neck), and erector spinae muscles (back bordering the spine). With the exercise bar 50 located generally overhead at location 34-90°, the targeted muscles are the latissimus and posterior deltoids, teres major, bicep brachii, brachialis, and brachioradialis. When the exercise bar 50 is relocated to position 34-75°, the muscles targeted for these positions are the latissimus dorsi and posterior deltoid muscles. When the exercise bar 50 is relocated to position 34-60° the muscles targeted are latissimus dorsi and serratus anterior. When the exercise bar 50 is relocated to position 34-45°, the muscles targeted are the posterior deltoids, rhomboids major and minor and latissimus dorsi. When the exercise bar 50 is relocated to position 34-30°, the muscles targeted are the posterior deltoids, rhomboid major and minor, and interior trapezius. When the exercise bar 50 is relocated to position 34-15°, the muscles targeted are the erector spinae and posterior deltoids.

These exercises targeting the denominated muscle groups are contemplated being performed in either a substantially upright position using the seat back 14 for support or sitting forward on the seat 12 away from the back 14. The seat back 14 can be reclined and set into a fixed position using adjustment supports (not shown) so that the seat back 14 assumes a semi or fully recline position. Any adjustment support such as a bar extending outward and downward from the back of the seat back 14 and engaging a series of stops extending outward located along flat space behind the seat 12 will position the back 14 at differing angles depending upon the point of engagement of the bar with the stops. Alternatively, any other seat back angling mechanism known in the art will suffice. As the position of the user's body with the seat 12, the seat back 14, or the location of the seat from the exercise device change, different muscle groups will be targeted as the user performs different exercises.

Figure 4:
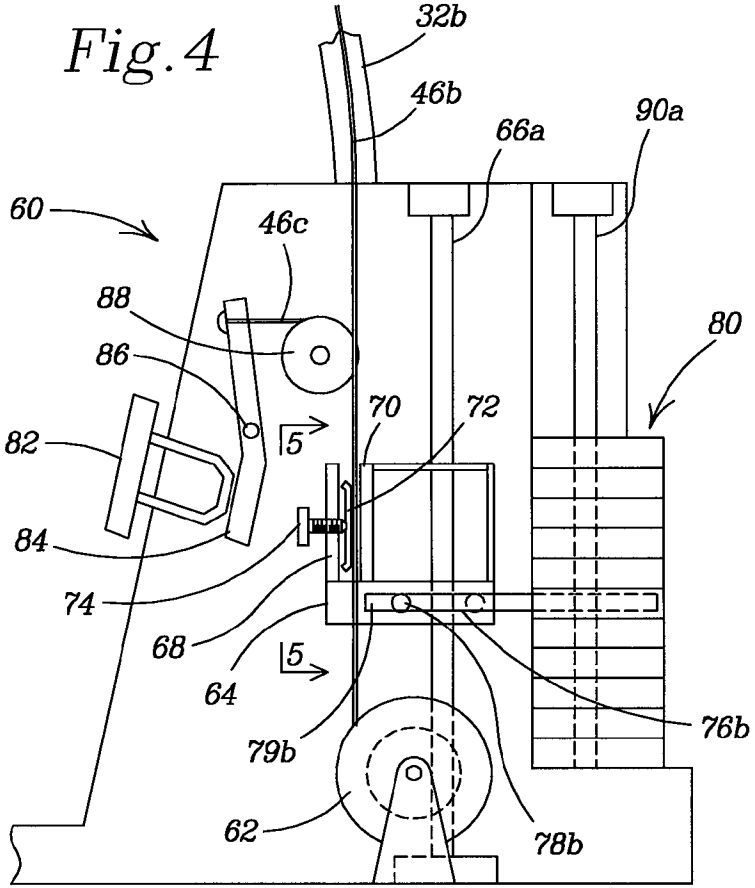
FIG. 4 is an internal side elevational view of the base of the multi-function exercise machine of the present invention showing the lift cable tracks, the weight platform, and leg press lever/cable arrangement.

In referring to FIG. 4, the mechanisms located within the base 60 can be described. One of the paired cables 46, i.e., 46*b*, extends through track 32*b* and down into the base 60. Cables 46*b*, 46*a* (not shown) continue to extend downward through weight adjustment platform 64 that is vertically adjustable along a paired set of guiderails 66*a*, 66*b* that maintain the platform 64 aligned in both horizontal and vertical planes. Extending upward from weight adjustment platform 64 is a support bracket 68 through which at least three threaded apertures are bored. Parallel to the bracket 68 is a platen 70 that serves as a rigid backing for clamping the cables 46*a*, 46*b* against. A compression shoe 72 is connected to the distal end of one of at least three threaded bolts 74 that extend through the support bracket 68 and serves to clamp the cables 46*a*, 46*b* against the platen 70 so that the cables 46*a*, 46*b* remain in a fixed position in relation to the weight platform 64 such that the weight platform 64 moves in direct relation to the distance moved by the cables. With the threaded bolts 74*a*, 74*b* tightened down against the respective cables 46*a*, 46*b*, the weight platform follows the movement of the cables 46*a*, 46*b* exactly. Alternatively, other cable engagement fasteners may be used to fasten and hold in place the cables 46 against the platen 70. Spring loaded clamps may be used with a lever action on the outside of the support bracket 68 and a spring forcing a compression shoe 72 inward capturing the cables 46*a*, 46*b* against the platen 70 and preventing any sliding motion of the cable against the weight platform 64 during use.

In order to adjust the level of the weight platform 64, the threaded bolts 74*a*, 74*b* are loosened so that the cables 46*a*, 46*b* are not compressed against the platen 70 and the weight platform 64 is free to move vertically up and down along the guiderails 66*a*, 66*b* to be positioned in correlation to a selected weight in the weight stack 80. Once positioned, the paired set of weight engaging rods 76*a*, 76*b* are extended from along each side of the weight platform 64 to engage the selected weight in the weight stack 80. Weight engaging rod extending pins 78*a*, 78*b* are used to extend each of the weight engaging rods 76*a*, 76*b* that are inserted into a cooperating round opening of similar dimension in the selected weight from the weight stack 80 by sliding the pins 78*a*, 78*b* forward along the slots 79*a*, 79*b* in the sides of weight platform 64. All of the weights above the selected weight in the weight stack 80 will then move upward and downward along a paired set of guiderails 90*a*, 90*b* in coordination with the weight platform 64, and in conjunction with the motion of the cables 46*a*, 46*b* through the paired tracks 32*a*, 32*b*.

Figure 5:
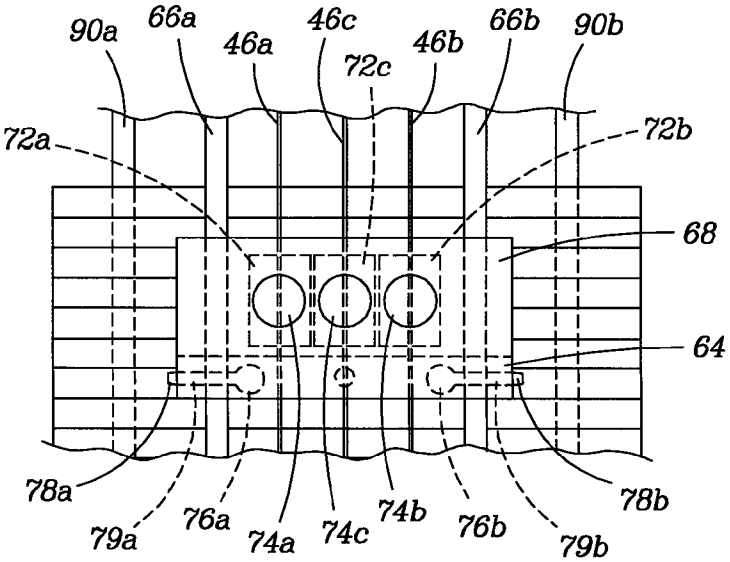
FIG. 5 is a sectional view of FIG. 4 showing the adjustment controls and cable arrangement for the weight platform of the present invention.

Referring to FIGS. 4, 5, and continuing to describe the exercise mechanisms positioned within the base 60, leg press exercises can be performed by a user in seat 12 by using a push plate 82 that acts against a lever and pulley mechanism attached by cable 46*c* to weight platform 64 to exert a counterweighted force that is also adjustable by increasing or decreasing weight/resistance. By exerting a force against the push plate 82 by using one or both legs, a user can perform several exercises focusing on the lower body and extremities. The push plate 82 is mounted against the front of base 60, extending through the front wall and engaging the proximal end of a pivotally mounted plate 84 extending laterally to be engageable along the entire width of the push plate 82. The pivotally mounted plate 84 is divided in approximately equal upper and lower sections divided by the pivot pin 86. The lower section is situated directly behind the push plate 82 and the upper section extends upward terminating at its distal end adjacent a pulley 88 that carries cable 46*c*. At the distal end of pivot plate 84, one end of cable 46*c* is fixedly mounted by clamping or other suitable means so that cable 46*c* exactly follows any forward or rearward motion of the distal end of pivot plate 84.

Cable 46*c* extends away from pivot plate 84 and runs over pulley guide wheel 88 to change direction downward and connect with the weight plate 64 in a similar manner as described above in connection with cables 46*a*, 46*b*. Cable 46*c* passes between support bracket 68 and platen 70 extending upward from weight plate 64 and may be compressed in a fixed position against the platen 70 by compression shoe 72*c* as threaded clamp 74*c* is tightened. In order that there be separate functioning of the weight plate 64 in response to the exercise bar 50 or the leg push plate 82, only cables 46*a*, 46*b* are clamped for use of the exercise bar 50 and only able 46*c* is clamped for use of leg push plate 82. Regardless of which clamps 74 are engaged, the other clamps are disengaged so that the weight plate 64 only responds to the motion of either the exercise bar 50 or the leg push plate 82. Any disengaged cables, cable 46*a*, 46*b* or 46*c*, are retracted onto self-retracting cable wheel 62 that is divided into like segments so that each segment of cable wheel 62 will independently take up the slack for any disengaged cable while maintaining appropriate tension for any engaged cable. In this manner the weight plate 64 responds only to the compressed, engaged cable(s) with the disengaged cable(s) appropriately retracted and passing through the weight plate 64 unfettered so as not to interfere with the ongoing exercise regimen.

In order that the active cables 46*a* and 46*b*, or 46*c*, are appropriately engaged with the weight platform 64, the leg press exercise mechanism is pivoted upward out of the way to provide access to the clamps 74 and the vertical adjustment of the weight platform 64. The weight platform is vertically adjusted by loosening all of the clamps 74 and positioning the weight platform 64 opposite the appropriate weight in the weight stack 80 and sliding the pins 78*a*, 78*b* forward to engage the cooperating aligned aperture in the selected weight. Then the appropriate clamps 74 are engaged, clamps 74*a*, 74*b* for cables 46*a*, 46*b* for the exercise bar 50, or clamp 74*c* for cable 46*c* for the leg push plate 82, with the other clamp(s) 74 disengaged. In this manner, the weight plate 64 is engaged with the appropriate cable(s) to respond to either the exercise bar 50 or the leg push plate 82. Once the appropriate weight is selected and engaged and the applicable cable(s) is/are engaged, the leg exercise mechanism is lowered into place and the exercise regimen can begin.

The exercises that are contemplated by the use of the leg push plate 82 are exercises for the lower body and legs. The targeted muscle groups are the gluteus maximus (buttocks) and the quadriceps femoris, hamstring muscles, tendo calcaneous, gastrocnemius and tibialis anterior (legs). The seated squat exercise can be accomplished by moving the seat 12 forward and having the seat back 14 in a substantially upright position. The user's legs engage the leg push plate 82 bringing the knees upward closer to the chest. The targeted muscles for the leg squat exercise regimen are the gluteus maximus (buttocks) and the quadriceps femoris, biceps femoris, semitendinosis and semimembranosis (hamstring muscles), tendo calcaneous (Achilles tendon), and gastrocnemius, all associated muscle groups in the legs. A second exercise is a leg press motion that can be accomplished with the seat 12 in a forward position and the seat back 14 partially reclined. The targeted muscles for the leg press exercise regimen are the gluteus maximus (buttocks) and the quadriceps femoris, biceps femoris, semitendinosis and sem imembranosis (hamstring muscles), tendo calcaneous (Achilles tendon), gastrocnemius, and tibialis anterior, all associated muscle groups in the legs.

The exercise machine of the present invention is a combination exercise machine featuring a wheelchair simulation exercise in combination with upper body pulls and leg pushing exercises. The multi-function exercise machine, which provides exercise regimens for the upper, middle and lower body, has the potential to be used by both able-bodied persons and persons with disabilities of differing scope. The machine can be used in a gym or fitness exercise location, or in an individual user's home. The exercise machine of the present invention affords full body exercises, all from the seated position. With the addition of the forward and rearward wheel exercise, a new and additional exercise regimen, using one or more different muscle groups, is introduced into the multi-function exercise machine field.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

The invention claimed is:

1. A multi-function exercise apparatus for a seated user comprising:

a base having a front section and a rear section;

an upright seat mounted to said rear section of the base and being adjustable forward and rearward in relation to the front section of the base, said seat also being reclinable over a range from a fully upright position to a fully reclined position;

a pair of stationary exercise wheels located on either side of said seat being rotatable in both the forward and rearward directions by the seated user; said rotation of the wheels being user adjustable, to provide more or less friction, by increasing or decreasing the force required to rotate the wheels;

an arched overhead support for holding a pull-down bar operable by pulling toward the seated user from a retracted position; said pull-down bar being relocatable from directly overhead to directly in front of said user;

a leg press pad directly in front of the seated user operable by the user pushing forward against the pad;

said pull-down bar and leg press pad capable of exerting a counter-weighted force against the force of the user with said counter-weighted force being adjustable by increasing or decreasing the exerted weight/resistance force of a series of weight units by adding or removing weight units; and, an exercise function counter-weight selection and adjustment control for selectively adding or removing weight units and selecting the pull-down bar or leg press pad for connection to the selected weight units for the exercise function selected by the user.

2. The multi-function exercise apparatus of claim 1, wherein the weight units are located in the front section of the base with each weight unit arranged atop one another in a stack and individually or collectively movable up and down along a paired set of guiderails.

3. The multi-function exercise apparatus of claim 1, wherein the pull-down bar is mounted to a relocatable trolley configured to move along the arched overhead support that may be adjustably relocated along the arched overhead support to predetermined positions and secured in said relocated positions by a pair of adjustment locking controls to secure the trolley in the relocated position.

4. The multi-function exercise apparatus of claim 3, wherein the trolley provides a paired set of guides to permit a pair of cables that are located and extend or retract within the arched overhead support to be directed toward and attached to the pull-down bar without impeding their movement.

5. The multi-function exercise apparatus of claim 1, wherein the exercise function counter-weight selection and adjustment control is located between the pull-down bar and the leg press pad and the weight units such that the cables extending between the pull-down bar and the leg press pad are selectively engaged on the exercise function counter-weight selection and adjustment control so that motion of the pull-down bar or leg press pad are translated to the selected weight units to provide the counter-weighted force against the force of the user.

6. The multi-function exercise apparatus of claim 5, wherein a set of extension rods mounted on the exercise function counter-weight selection and adjustment control are manually extendible to engage any one of the selected weight units to create an individual or combination set of weight units for use as the counter-weighted force against the force of the user.

7. The multi-function exercise apparatus of claim 5, wherein a set of cable clamps are selectively engaged to capture one or more cables to interconnect either the pull-down bar or the leg press pad through the exercise function counter-weight selection and adjustment control to the selected weight units.

8. The multi-function exercise apparatus of claim 1, wherein a friction adjustment control is positioned adjacent each of the stationary wheels to provide more or less friction, thus increasing or decreasing the force required to rotate the wheels.

* * * * *